US007442870B2

(12) United States Patent
Lengeling et al.

(10) Patent No.: US 7,442,870 B2
(45) Date of Patent: Oct. 28, 2008

(54) METHOD AND APPARATUS FOR ENABLING ADVANCED MANIPULATION OF AUDIO

(75) Inventors: Gerhard Lengeling, Los Altos, CA (US); Jan-Hinnerk Helms, Hamburg (DE); Gunter Mensch, Wedel (DE); Clemens Homburg, Hamburg (DE)

(73) Assignee: Apple Inc., Cupertino, CA (US)

( * ) Notice: Subject to any disclaimer, the term of this patent is extended or adjusted under 35 U.S.C. 154(b) by 415 days.

(21) Appl. No.: 10/751,310

(22) Filed: Jan. 2, 2004

(65) Prior Publication Data

US 2005/0145099 A1 Jul. 7, 2005

(51) Int. Cl.
*G10H 1/00* (2006.01)

(52) U.S. Cl. ..... 84/625; 84/697; 84/645

(58) Field of Classification Search ..... 84/625, 84/660, 697, 698, 603, 645
See application file for complete search history.

(56) References Cited

U.S. PATENT DOCUMENTS 6,924,425 B2 * 8/2005 Naples et al. ..... 84/609

2002/0082837 A1 6/2002 Pitman et al.

OTHER PUBLICATIONS

ACID User's Manual (Sonic Foundry Europe. 1999)□□.*

* cited by examiner

*Primary Examiner*—David S. Warren
(74) *Attorney, Agent, or Firm*—Hickman Palermo Truong & Becker LLP

(57) ABSTRACT

A method and apparatus are provided for representing, storing, and rendering audio data. An audio file enables users to store and exchange sampled audio waveform data along with additional data used to generate or synthesize an audio output closely approximating the original waveform data. The audio file used to generate a piece of music may include note events, synthesis parameters, instruments and track information, and other information for shaping music notes, as well as playback characteristics for emulating a desired ambiance. A rendering apparatus may implement a process for selecting the representation of audio data most likely to provide the best fidelity for the given playback circumstances. The combined audio format also provides a greater degree of compatibility for audio players with different playback capabilities.

29 Claims, 7 Drawing Sheets

METHOD AND APPARATUS FOR ENABLING ADVANCED MANIPULATION OF AUDIO

BACKGROUND OF THE INVENTION

1. Field of the Invention

This invention relates to the field of computer software and hardware for generating and manipulating audio data. The invention relates more specifically to a method for storing audio data in a file format that lends itself to advanced audio manipulation of audio.

2. Background Art

Whether it is for developing a video game or producing a movie, creative artists and sound engineers often seek to produce audio effects that match visual scenes, or adjust and synchronize different musical tracks to form a single cohesive composition. With the help of computers, these users are able to generate sounds, compose music or alter existing audio to produce the desired effects. Artists may also exchange audio data or procure libraries of sounds and music loops to expand their creative capabilities.

To alter a sound or music loop, the artist may use software applications and/or electronic music hardware that provide tools for loading audio data and applying one or more computation techniques to produce a desired effect. Audio data are typically stored in a digital format (e.g. Compact Disks and MP3 formats) in the form of numerical values representing sampled audio waveforms at a chosen sample rate, typically twice the highest sound frequency audible to humans (around 24,000 Hz). Synthesized (i.e., artificially generated) music on the other hand can be stored in encoded form, which allows a player to read specific instructions and render the music by synthesizing the encoded notes.

Existing applications for audio data manipulation (e.g. computer software applications and dedicated hardware such as music synthesizers) provide numerous tools for manipulating audio data. Some applications provide tools for directly manipulating audio waveforms, typically by carrying out complex computations on the audio signal. Such tools include the use of signal analysis algorithms such as frequency domain spectral analysis(e.g., for the application of digital filters) and amplitude analyses (e.g., for determining transients and segments of interest in a waveform).

While the latter techniques are successful at producing many desired audio effects, they are often limited both in the physical range of manipulation and the type of manipulation(s) that can be performed. For example, every alteration of the spectrum of an audio track is likely to introduce audible frequency distortions that may be unacceptable to the human ear in some range limits. Other alterations, such as segment deletion, may also produce undesirable effects. For example, after deleting a music segment, the reverberation associated with a sound in the deleted segment can still be heard in the remaining segments that follow, even though the junction between remaining segments is properly corrected and made unnoticeable to the human ear. In other instances some desired effects may not be possible using the above tools. For example, one may not be able to extract an instrument from a recorded music performance, or apply changes to specific music notes in a performance.

Other existing applications for generating and manipulating audio data store and process music data in an encoded form. Music data encoded in the MIDI (Musical Instrument Digital Interface) format, for example, provides information about note events, the instrument(s) used to make a particular note, and the acoustic playback environment (e.g. the ambiance in which the composer intends for the music to be heard). When played back, the instrument library of the player device is used to generate the musical output. These instrument libraries can vary in performance from device to device, and even from version to version of the same device (e.g., the sound of a synthesized trumpet may vary from system to system. Therefore, a user may play the MIDI encoded music with only a limited fidelity to the original composition.

There is a dichotomy in current applications providing audio handling tools. Users are either forced to work on a pre-constructed signal (e.g., a sampled signal) that offers the original characteristics of the sound, or they are forced to work with encoded compositions without having access to the original sounds (i.e., as the author intended them to be heard). There is a lack of audio file formats that enable applications to play back audio data with the highest fidelity to the original composition, while providing access to the original recorded audio and allowing for manipulation of the audio data.

Therefore, there is a need for an audio format that provides audio data in a way that allows for reconstructing audio effects and manipulating audio data, while preserving the quality of sound of the original composition.

SUMMARY OF INVENTION

The invention provides a method and apparatus for representing, storing, and rendering audio data. One embodiment of the invention combines various representations of audio data for storage and exchange using a single repository, such as a computer file. Those various representations may then be applied in a playback apparatus to achieve optimum fidelity, regardless of any audio manipulation of the data between original creation and ultimate rendering.

In accordance with one or more embodiments of the invention, an audio file combines available audio data of various types for any given piece of audio. For example, the audio file may enable users to store and exchange sampled audio waveform data along with code that may be used to generate or synthesize the audio data in a manner closely approximating the original waveform data. The audio file used to generate a piece of music may include, for example, the note events, the synthesis parameters (such as the waveform envelope used for each note), the instruments and track information, and any other information for shaping the music notes. Furthermore, embodiments of the invention may also collect and store information about playback characteristics. Those characteristics allow a player to render encoded sounds in a manner simulating the performance environment intended by the author.

With different aspects of audio data made available, the user of an embodiment of the invention may access and manipulate any given feature of the audio data. For example, a user may choose to change one or more notes, an envelope of a note, the tempo, the pitch, an instrument, a playback parameter or any other aspect of the audio data of a music piece. The user may modify any or all of the latter, then re-synthesize the piece of music, potentially, free of any artifact that may otherwise arise through other existing signal processing tools.

In accordance with one or more embodiments, a rendering apparatus may implement a selection method whereby the representation of audio data most likely to provide the best fidelity within the given playback circumstances is selected for use in the rendering process. For example, where the audio data is to be played back without modification, the audio waveform data may be played directly. Yet, where a user specifies some modification of the audio performance that would degrade sound quality under direct playback, the rendering apparatus may select the encoded audio data and synthesis information to synthesize the modified performance in an accurate and undistorted manner. This selection process performed by the rendering/playback apparatus provides an unprecedented level of flexibility in performing sound manipulation while preserving a high level of fidelity of audio rendering.

The combined audio format also provides a greater degree of compatibility with different types of audio players. For example, players with minimal capability may simply play back the audio waveform data, whereas players that operate on encoded data (e.g., MIDI players) may play back the encoded representation. More advanced synthesizers can take advantage of the synthesis and playback information, in addition to the encoded audio data, to render a high fidelity performance.

DETAILED DESCRIPTION

Figure 1:
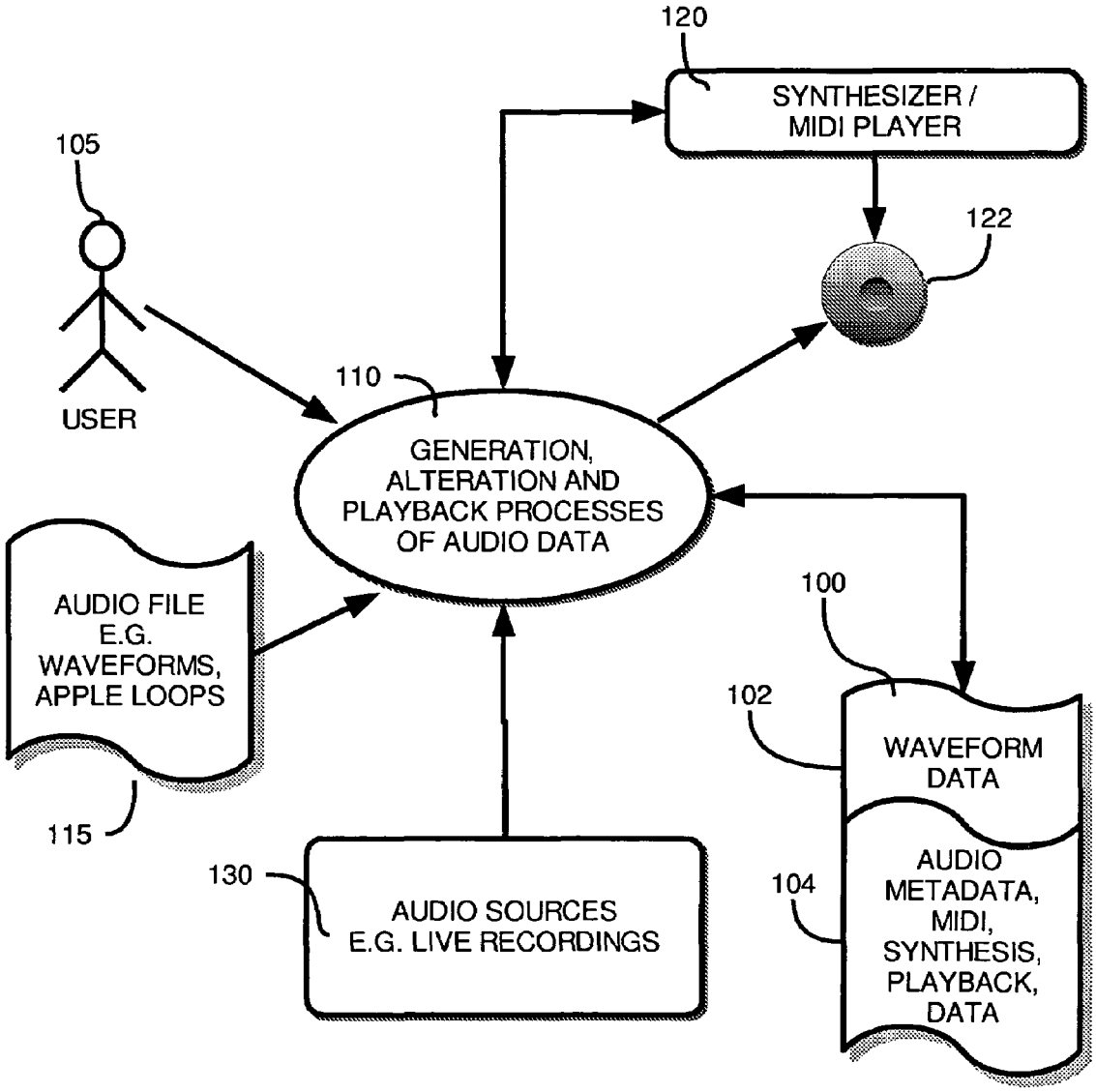
FIG. 1 is a block diagram depicting the environment in which embodiments of the invention provide capabilities to users to create, edit and manipulate audio data.

The invention provides a method and apparatus for representing, storing and rendering audio data. In the following description, numerous specific details are set forth to provide a more thorough description of the present invention. It will be apparent, however, to one skilled in the art, that the present invention may be practiced without these specific details. In other instances, well known features have not been described in detail so as not to obscure the present invention.

Terminology

In general, the phrase "audio data" refers to any type of audio data (or combination thereof). In the following description, audio data may also refer to one or more tracks of sampled audio signals, or to the combination of the sampled signal, an attached set of descriptives of the audio data and the encoding of the data. The term "waveform" refers to a sampled version of an analog signal (e.g., an analog recording input), and "metadata" refers to descriptive data related to the audio work.

The term "player" refers to a rendering device such as a MIDI-enabled player, a stereo system equipped with loud speakers, and any other device capable of receiving and rendering/playing audio data. A player may also refer to an output device such as a compact disk burner. In the latter case, for example, an automatic computer process may perform computation on input audio data and output the resulting data directly to a storage device (e.g. magnetic tape, a laser disk burner or any device capable of rendering and/or storing the audio data).

The term "metadata" refers herein to a set of descriptive data associated with one or more sets of audio data. For example, whereas an audio file may contain sound data for music or speech, the associated metadata may contain a date of recording, the topic of a speech, the music genre, specific instruments or types of instruments represented, or any other type of descriptive data. Metadata may be represented using one or more data formats. For example, metadata may be stored using extensible markup language (XML). XML is a standard that enables users to represent data structures using user-defined tags.

Embodiments of the invention may use metadata that may be stored as part of a data file or in one or more separate files associated with an audio file. Metadata may also be represented as one or more records of one or more database tables in a relational database, on a network storage location that streams the data, or on any other data storage means.

Throughout the following disclosure, a "user" may refer to a person using a computer application and/or to one or more processes, some of which maybe automatic. The automatic processes may be a computer program executing locally or on remote host, and may be triggered to communicate with embodiments of the invention following an event.

The following description uses music applications for purposes of example only. It will be apparent to those of skill in the art that the methods and apparatus of the invention are applicable to other media applications as well.

Overview of the Invention

Typically in current technologies, a media author distributes a rendered version of his or her media work. The rendered version is usually stored as a sampled waveform (possibly compressed) on digital media. Synthesizing instructions used to generate the media work (if any exist) are generally unavailable to other users. When the media work is intended for other users to manipulate, the author may distribute the synthesizing instructions (e.g., MIDI encoded data) that are capable of driving a synthesizer to reproduce the desired sound composition. In the latter case, the recipient of the media work is able to render the media work without access to the original composition. However, due to differences in synthesis implementation, this rendering will not be a precise replay of the media work, unless the recipient uses the same synthesizing equipment that was used to produce the original work. For example, the differences between the way each player manufacturer implements an instrument, such as a "grand piano", can significantly affect the end-results of playing the encoded information on different players.

Embodiments of the invention gather audio data of several types, including recorded data capable of being streamed directly to an output device (e.g., speakers or headphones), and encoded data used to synthesize the audio output. Applications implementing the invention may play back audio compositions with high fidelity, while permitting users to alter and manipulate the audio data to produce their own compositions with substantially the same fidelity.

FIG. 1 is a block diagram depicting an environment in which embodiments of the invention may provide users with the capability to create, edit and manipulate audio data. In FIG. 1, block 110 represents a set of processes that provide tools for creating and/or rendering the audio data as disclosed herein. In one embodiment, processes 110 may be implemented as one or more computer programs capable of executing on a computer having a processor, memory and storage capabilities. In other embodiments, processes 110 may be implemented in hardware or firmware, or some combination of hardware, firmware and software. Processes 110 may also be implemented in a device whose main function is to play and/or generate audio. Such devices may include, for example, digital synthesizers, MIDI players and any other device capable of executing processes 110.

Processes 110 may also include one or more user interfaces enabling the user to access and monitor (e.g., audibly and visually) audio data. A computer application implementing the invention may be configured to access and utilize third party software libraries and third party data formats, which provides means to the application to execute the invention on other type of audio data file formats and data structures either directly or by converting the data into a data layout compatible with the application.

Processes 110 may receive instructions from a user 105 to access and load audio data from a plurality of sources. For example, a user 105 may load audio files 115 from a storage location, such as a disk drive, memory card or web server. The user may also collect audio data from a recording device 130 (e.g. a microphone, a multimedia player, a sound system or any other device capable of capturing sound data).

Processes 110 may receive/exchange audio data from/with a synthesizer/player 120. For example, a user using a computer may use an interface (e.g., from a media software application) to input instructions that are sent to synthesizer 120, which renders those instructions into sound on an output device 122. Synthesizer 120 may return data back to the computer, which user 105 may then modify to obtain a desired audio effect.

Processes 110 may also load a new data representation 100 (disclosed in detail below) of audio data that allows the user to edit, re-construct, playback and manipulate the audio data. Data representation 100 combines an audio waveform 102 with encoding data 104. Audio waveform 102 provides user 105 with access to the sound as its author meant for it to be heard, and encoding data 104 provides user 105 with access to the instructions used to compose/synthesize the audio waveform 102. For example, user 105 may be a musician who improvises a piece of music on a synthesizer keyboard 120, in which case the synthesizer 120 is capable of capturing and communicating the encoded information to the computer running processes 110. In one embodiment, user 105 is able to graphically view, edit and alter the encoded information.

In a sound studio environment, an artist may run a sound processing system or a computer system executing a software application that is enabled with a set of processes 110 for generating, capturing, altering and manipulating audio data. The computer system may be interfaced with one or more audio/multimedia creating/editing devices 120, and one or more output devices 122. The creative artist may capture new audio data through interfaced devices 130, and/or may load existing audio data 100 and 115 from local and/or remote locations.

The creative artist can perform a number of manipulations on audio data to obtain a desired result, such as to form sounds that evoke specific emotional responses or to match the timing of actions in a visual scene. Embodiments of the invention enable the artist to store all of the combined audio information in a single repository, which provides access to the audible end-result as well as the composition code/instructions used to generate the audio.

Waveform Audio Data

Figure 2:
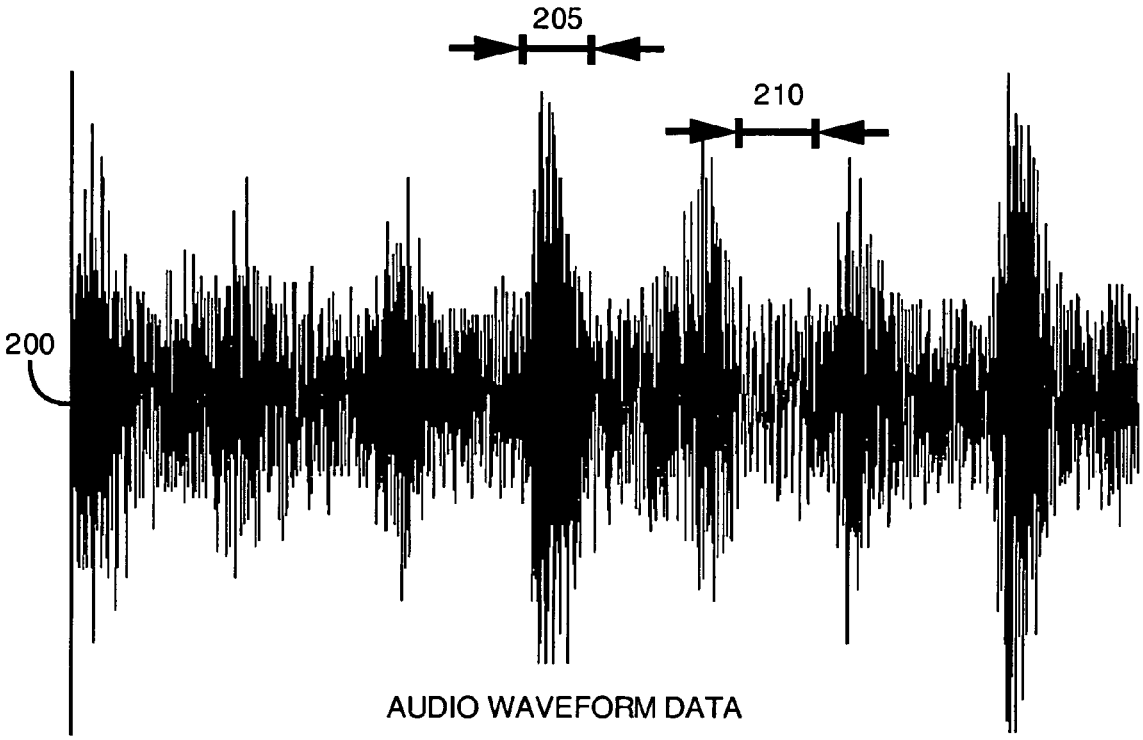
FIG. 2 is a plot of an audio waveform (amplitude versus time), representing audio waveform data that may be represented in one or more embodiments of the invention.

FIG. 2 is a plot of a typical audio waveform as used in embodiments of the invention. Audio data waveform 200 may be, for example, a ten second piece of a music recording. Waveform 200, like most audio recordings, may be characterized by transients (e.g. transient 205) representative of one or more instruments that keep a rhythmic beat at regular intervals (e.g. interval 210). The waveform is generally sampled at a rate twice the highest sound frequency audible to humans, typically around 24,000 Hz, though other sample rates may be used within embodiments of the invention. Waveforms of voice recordings also possess some characteristics that are distinct from the music. Waveforms that are associated with sounds that are not musical in nature may exhibit more pauses, and usually an absence of rhythm (i.e., lack of uniform intervals between transients.

There exist multiple methods for storing and eventually compressing audio waveforms. For example, Apple Computer,™ Inc. has developed the Audio Interchange File Format (AIFF), and Microsoft™ Corporation has developed the WAV file format. Other file formats for storing waveform data include, for example, HTK, ESignal, OGI, Sound Designer I and many other file formats. Generally, these file formats define a header that may contain information such as sampling rate, sampling periods, header size, file size, track number, information associated with each individual track, and any other information to enable media applications to properly load and play the waveform. The specifics of these file formats are not detailed herein, as these file formats are well defined and widely available to those of ordinary skill in the art.

Embodiments of the invention may be configured to load, produce and manipulate waveform data in any of the available file formats.

Waveform Descriptive Data

In most cases, waveforms alone are insufficient to provide any assistance in managing large numbers of recordings. Apple Computer™ has developed a file format (referred to as "Apple Loops") that incorporates metadata, enabling users to store other types of descriptive information within the audio file. This file structure is described in U.S. patent application Ser. No. 10/407,853, filed on Jun. 13, 2003, the disclosure of which is hereby incorporated by reference.

The Apple Loops file format enables a user to include information regarding or associated with the sounds in the waveform. For example, the user may enter information that provides for file searching capabilities utilizing subjective descriptions of the sounds. For example, an audio recording of a piece of music may bear a description such as "Cheerful", or a categorization descriptive, such as "Latin". The metadata may also contain descriptives concerning audible characteristics, such as music genre, relative cleanness/distortion, or any other attribute a user may select to associate with the waveform.

Furthermore, the user may specify time periods of interest (e.g. 205 and 210) and/or information regarding specific treatment applied to the waveform (e.g. real-time stretching, points of looping or any other type of user defined information). For example, metadata identifying the beginning of each transient may be used to implement tempo changes in the playback of the audio waveform. Embodiments of the invention may be configured to load, produce and modify descriptive data in one or more metadata formats.

Musical Instrument Digital Interface (MIDI) Data

As described above, the stored waveform data provide a player with the ability to play audio as it is recorded by the producer. In addition, the metadata, stored in the audio file allow for efficiently managing the audio data. However, creative artists and sound engineers desire a way to modify recorded audio while maintaining fidelity. Existing tools for manipulating waveform data utilize numerous techniques and algorithms that rely on processing the waveform using one or more signal processing tools. This approach has its limits because every waveform manipulation technique introduces signal distortion and/or side effects, which may result in audible artifacts or other undesired sounds.

Music has been more accessible for synthesis using hardware and software technology than speech or other naturally occurring sounds. In music the "note" can be regarded as the basic unit of information. A note is encoded as an "on" or "off" event associated with attributes such as a note number (pitch) and key velocity (loudness). The notes, their attributes and instruction about how to play the note (e.g. repeat, pause or any other instruction for a rendering machine) can be encoded in simple codes, stored and exchanged between machines. The Musical Instrument Digital Interface (MIDI) is a set of specifications and protocols for hardware and computer software to exchange and render music data. MIDI files are organized into what are referred to as "chunks". Typically, a chunk has the data structure shown in Table 1.

TABLE 1

| Type | Length | Data |
|---|---|---|
| 4 bytes | 4 bytes | "Length" bytes |

Each chunk holds data specifying the "type" of chunk, the "length" (or size ) of the data stored in the chunk, and the instruction set (the "data"). There are two types of chunks: the header chunks identified with "MThd" and the track chunks identified by a "MTtk". A MIDI file typically has one header chunk followed by one or more track chunks, stored in a binary format that player devices (e.g., synthesizers) are capable of interpreting.

The header chunk specifies the overall characteristics of the music data stored in the track chunks. For example, the header chunk specifies the file format indicator, the number of track chunks contained in the file, and the default delta-time (time lapse between ticks in the music).

The track chunks specify one or more delta-time/event pairs. An event can be, for example, one of the following: a MIDI event, defining channel messages; a system exclusive event (sysex-event), defining system specific messages; or a meta-event, defining metadata such as the title of a song, lyrics and any other information that may accompany the music.

Embodiments of the invention may be configured to load and produce chunks of encoded data representing synthesis instructions, such as the MIDI data described above. The MIDI format is described herein as an example of one possible instruction encoding protocol available to load encoded audio data.

Synthesis Parameter Data

Any waveform can be algorithmically decomposed into one or more additive sine wave components, each having a specific period, amplitude and phase. Audio synthesis utilizes the inverse of this concept to generate waveforms by combining a number of sine waves (e.g., generated by programmable oscillators). Audio synthesizers implement or simulate any number of oscillators and filters to produce sound waveforms. Any number of oscillators and filters may be utilized, for example, to emulate a specific instrument.

Most modem electronic synthesizers have a built-in capability of simulating a number of instruments. The electronic circuitry (e.g. the combination of oscillators and filters) for producing a specific sound (e.g. instrument) is often proprietary. Thus, there are differences between machines due to specific implementations by manufacturers. MIDI files may contain system exclusive instructions that identify the instrument for playing a track or notes. For example, a synthesizer may provide three (3) different kinds of grand piano. In the latter case, the MIDI file stores the exact reference of the instrument, and the specific model of the synthesizer that produced the music.

In addition to generating specific sounds, synthesizers (e.g. hardware or software programs) may allow users to specify how music notes should be played. When an instrument is played by a human, the notes' sound follows the manner in which the human performs. For example, the force and velocity with which a person presses a key on a Piano keyboard is a crucial characteristic of the sound itself. Digital media simulate the latter by convolving the notes' events with envelope data. The envelope is a layer of data that determines how the synthesized sound (e.g. the output of oscillators) is shaped.

Data describing the characteristics of the envelope may be referred to as "synthesis parameters" because that data sets forth the specific synthesis treatment used to process a given sound. Different synthesizers and players may render the same instrument in a slightly different manner due to differences in the way the envelopes and oscillators are defined for a given instrument. The inclusion of synthesis parameters can provide a normalizing component to ensure that a synthesized instrument or sound is accurately rendered regardless of what type or brand of synthesizer or player is used, by virtue of the fact that characteristics such as the envelope may be specifically (re)defined for each sound or instrument. One or more embodiments of the invention may include in the audio file a "chunk" of data that stores the synthesis parameters for the audio composition.

Figure 3:
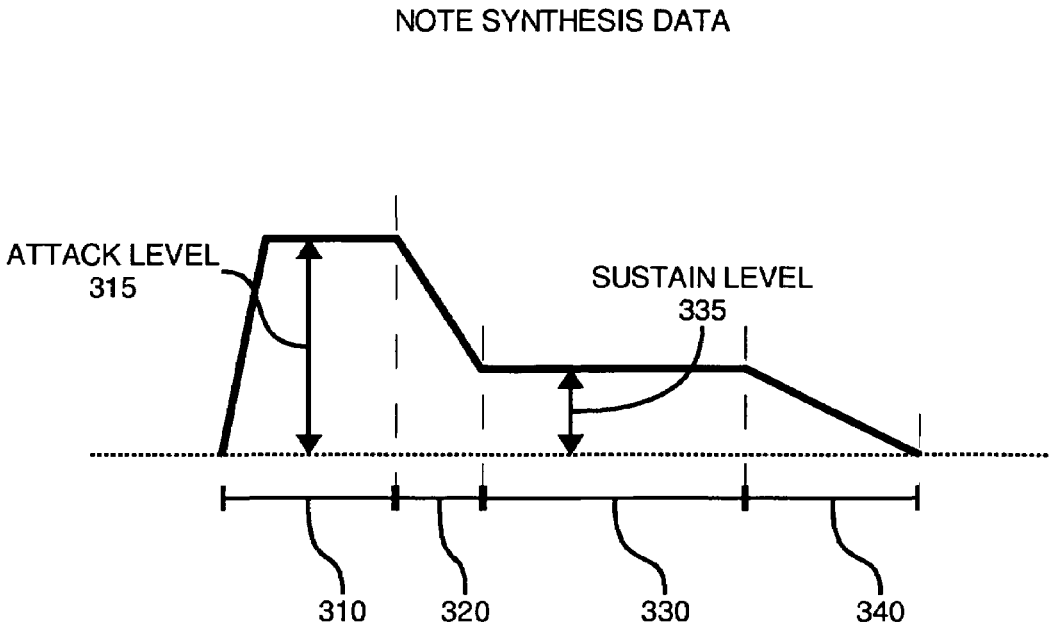
FIG. 3 shows a sound envelope that shapes how music notes may be rendered in one or more embodiments of the invention.

FIG. 3 shows a typical envelope that shapes how music notes are rendered in embodiments of the invention. An envelope is a shape representing amplitude versus time; it shapes the way a sound is played over time. The envelope is typically super-imposed over music notes of an instrument to produce, for example, a specific playing style. In the example of FIG. 3, the stages of the envelope shown are Attack 310, Decay 320, Sustain 330 and Release 340. Attack stage 310 represents the time the sound takes to rise from an initial value (e.g. base value or zero) to its maximum level 315. Decay stage 320 is the time for the initial falling off to the sustain level 335. Sustain 330 is the time during which the sustain level 335 is maintained. Release stage 340 is the time the sound takes to move from the sustain level 335 to its final level. The Release stage simulates the sound that continues to be heard after a key of an instrument is released.

Most modern synthesizers provide tools for selecting and/or creating envelopes that are more rich and complex than the simple envelope illustrated in FIG. 3. Furthermore, envelopes may be used as control signals that can be applied to various aspects of a synthesizer's sound, such as pitch, filter roll-off frequency, and overall amplitude.

Embodiments of the invention may be configured to collect, load, store and modify synthesis data in any given data format.

Playback Parameter Data

In addition to generating music notes and instrument sounds, creative artists and sound engineers also apply further processing to the audio data to realize certain sound effects. For example, after composing a piece of music, or obtaining a sample of a naturally occurring sound, an artist may wish to add a complex echo effect that emulates the playing of the piece of music in a concert hall or a cathedral, etc. Such effects may be achieved using signal processing algorithms such as finite impulse response (FIR) filters that mimic the acoustic properties of a natural or simulated rendering environment.

In one or more embodiments of the invention, such playback effects may also be encoded and stored in an audio file, similarly to the way music notes and synthesis data may be incorporated. For example, the coefficients of a FIR filter may be stored as a further "chunk" of data. Embodiments of the invention may utilize existing methods to collect, modify and store playback effects, and store such data in any available data structure or file format.

Rich Audio Data File Format

Figure 4:
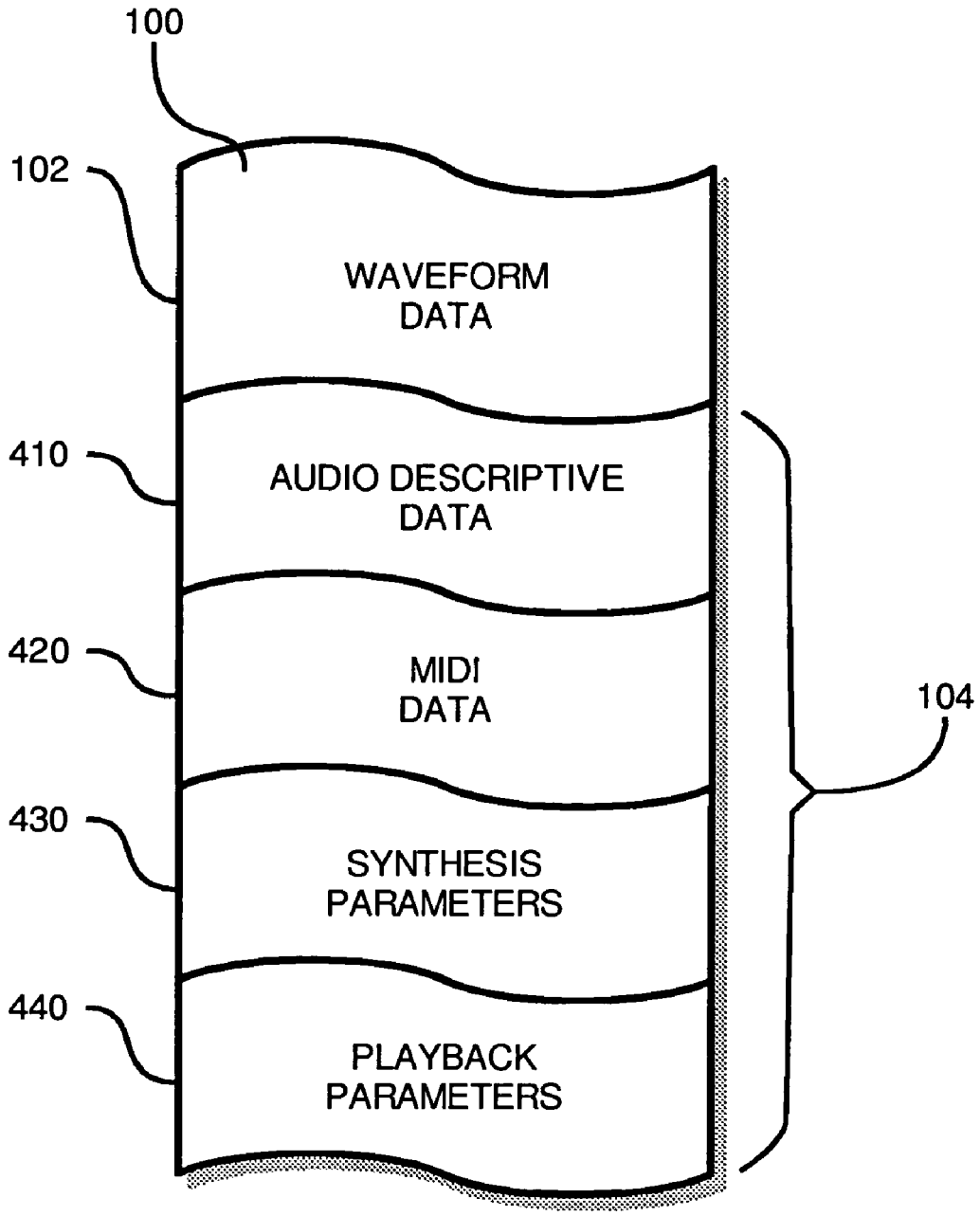
FIG. 4 represents a layout of an audio file as used in accordance with an embodiment of the invention.

FIG. 4 represents one possible embodiment of a layout for an audio file in accordance with an embodiment of the invention. The file layout in FIG. 4 represents the various types of information that may be combined in a single repository. Rendering apparatus in accordance with embodiments of the invention may be configured to gather the available data associated with any piece of audio, and organize that data for storage in a file. It will be apparent to one of ordinary skill in the art that the various components of the audio file may be laid out in any one of multiple possible combinations. For example, the audio data may be provided as waveform data and/or MIDI, while other data such as synthesis parameters and play parameters may be omitted. The layout of the file format in FIG. 4 is one example illustrating the capability for embodiments of the invention to provide several types of audio data, and should not be construed as the only layout available with respect to the type of data that may be stored and the ordering of the included components.

In FIG. 4, block 102 describes a component of the file that stores the waveform data. The data structure of the waveform component may be any of the existing file formats for storing waveforms (e.g. Audio Interchange File Format, WAVE file format, esignal or any other data structure capable of storing waveform data). Block 410 represents the file component that stores the descriptives associated with waveform data as defined above, or metadata associated with other types of audio data in the file. Block 420 represents note events data as it may be encoded using, for example, the MIDI format. Block 420 may include one or more MIDI chunks, or any other representation of music event data that enables a system to reconstruct music pieces. Block 420 may hold, for example, the information that allows a system to load the notes and/or instrument data, the identifiers of the player and instrument in which the music may have been composed, and any information that may be stored in a chunk.

Block 430 represent the file component that holds synthesis parameters. The synthesis parameters associated with any note event defines specific effects that are added to the sound data. The synthesis parameters may also include the identifiers of specific functions that may be retrieved from a device. For example, when an algorithm for obtaining a given sound effect is proprietary and available only in a given device, the device can be indexed with an identifier and the synthesis parameter that indicates the algorithm/function in question may be indicated by another identifier or a combination thereof. The synthesis parameter may further include a manufacturer identifier, a model number and an instrument identifier.

Block 440 represents the file component that holds data associated with playback parameters. Playback parameters define the special effects applied to audio data as it is rendered. Embodiments of the invention are capable of loading and exchanging files that hold data structures defining audio data in one or more formats and playback parameters. For example, an author may want to exchange audio data in a waveform data format along with the playback parameters to allow a recipient of the audio data to manipulate the playback parameters without having access to the encoded audio data that generated the piece of audio. This would enable an author of a media work to distribute the work and allow others to apply one or more playback manipulations without divulging the source code of a composition.

Creating a Rich Audio File

Figure 5:
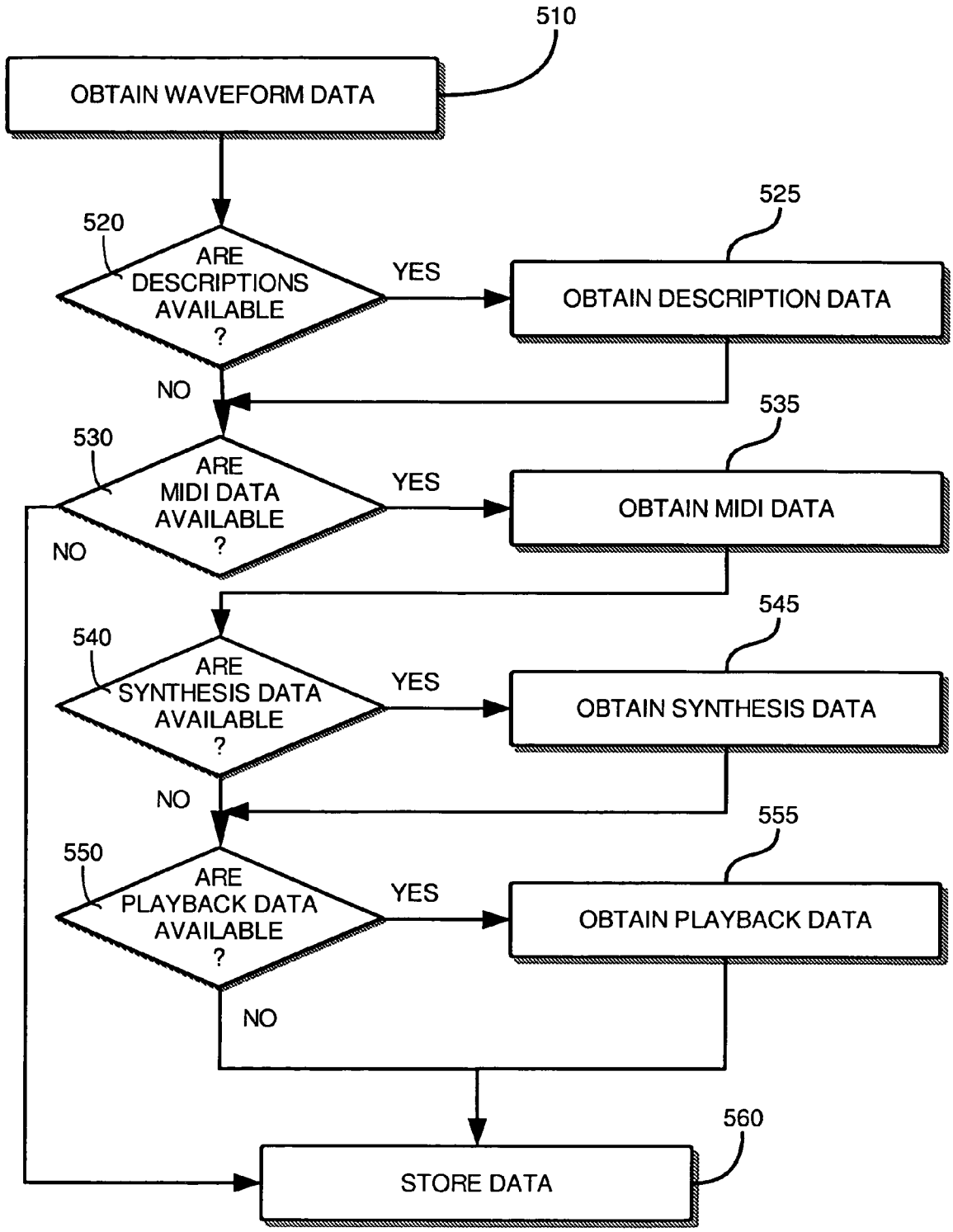
FIG. 5 is a flowchart illustrating steps involved in collecting and storing audio data in data files in accordance with an embodiment of the invention.

FIG. 5 is a flowchart illustrating a process for collecting and storing audio data in data files in accordance with an embodiment of the invention. It will be apparent to one of ordinary skill in the art that the steps in FIG. 5 are for illustrative purposes only and do not dictate the order or the number of steps required to implement the invention.

In FIG. 5, a system or application embodying the invention obtains waveform data when available, at 510. The waveform data may be available from a data file, a recording device or any other means for obtaining audio data (see FIG. 1 for detail). At step 520, the application checks for availability of descriptive data. Descriptive data may be available as a metafile, embedded data in an audio file (as described above), input by a user through a user interface or by any other means for obtaining descriptive data. The application implementing the invention collects, stores, loads and/or uses the descriptive data, when available, as data structures compatible with one or more file formats, at step 525. When descriptive data are properly organized in memory, or when not found, the application checks for the availability of MIDI data at step 530. When MIDI data are available, the application collects, stores, loads and/or uses the MIDI data as data structures compatible with one or more file formats at step 535.

The application checks for availability of synthesis data at step 540, and organizes the synthesis data, at step 545, in a data structures compatible with one or more file formats. When synthesis data are unavailable, or are collected and organized in memory, the application checks for the availability of playback data at step 450. If the latter are available or can be collected, the application organizes the playback data into data structures compatible with one or more file formats at step 555. As illustrated in FIG. 1, MIDI, synthesis and playback data may be obtained from a data file, through an interface with a synthesizer, through a user interface or through any other means capable of loading data.

At step 560, the application stores the collected audio data. Storing the data may refer, in addition to imprinting the data on a long-term storage medium, to transferring the data through a network (e.g. Ethernet) or through a serial connection to a device that handles file storage.

In one embodiment of the invention, the audio data other than the waveform data are appended, to the waveform data sections so as to preserve compatibility with existing applications that load waveform data. For example, the file format of the invention may utilize any of the existing file format (e.g. Audio Interchange File Format). By appending the rich audio information at the end of the audio file, media players may still read and play the audio file. In other embodiments, the audio data may be partitioned and stored in separate files or database records, and labeled with specific identifiers.

Loading and Executing a Rich Audio File

Figure 6:
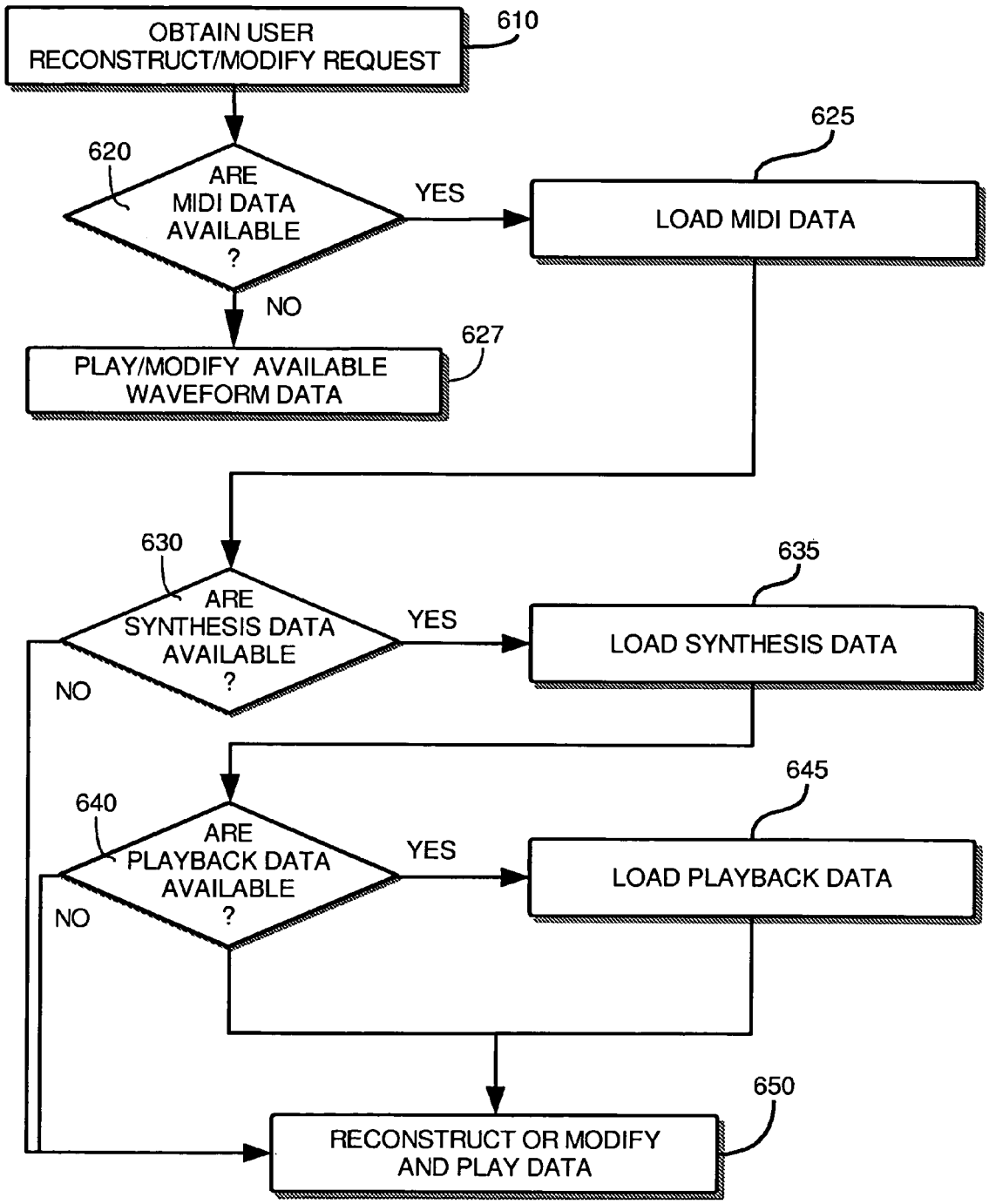
FIG. 6 is a flowchart that illustrates steps involved in fetching audio data in a data file in accordance with an embodiment of the invention.

FIG. 6 is a flowchart illustrating one embodiment of a process for fetching audio data in a data file in accordance with an embodiment of the invention. As stated above, the invention allows a user to playback audio data by providing access to the encoded data used to generate the sounds through a player (e.g., synthesizer or a personal computer), and at the same time allowing the user to modify the code when sound manipulations are desired.

At step 610, a rendering application embodying the invention obtains a request to load audio data for playback and/or manipulation. The rendering application determines whether the file contains MIDI data used to generate the sound, at step 620. If the MIDI data are not available, the rendering application allows the user access to the available waveform data and the tools provided for modifying the waveform data using existing signal processing tools, at step 627. If MIDI data are available, the rendering application loads the MIDI data, at step 625. The rendering application then determines whether the synthesis data is available at step 630. The rendering application loads available synthesis data at step 635, and then determines whether playback data are available, at step 640. The rendering application loads playback data as available, at step 545. Once all available MIDI, synthesis and playback data are loaded from the file, the system presents the user with the available tools that support the playback/reconstruction of the existing data, as well as tools for modifying the code to generate the audio, at step 650.

It is noteworthy that the latter steps need not be executed in the order just described. Further, in another embodiment, the rendering application may load any available waveform data for playback, and then proceed with loading the additional encoded data, synthesis parameters and playback parameters only if the user indicates an intent to modify the performance in some fashion.

Manipulating a Rich Audio File

Figure 7:
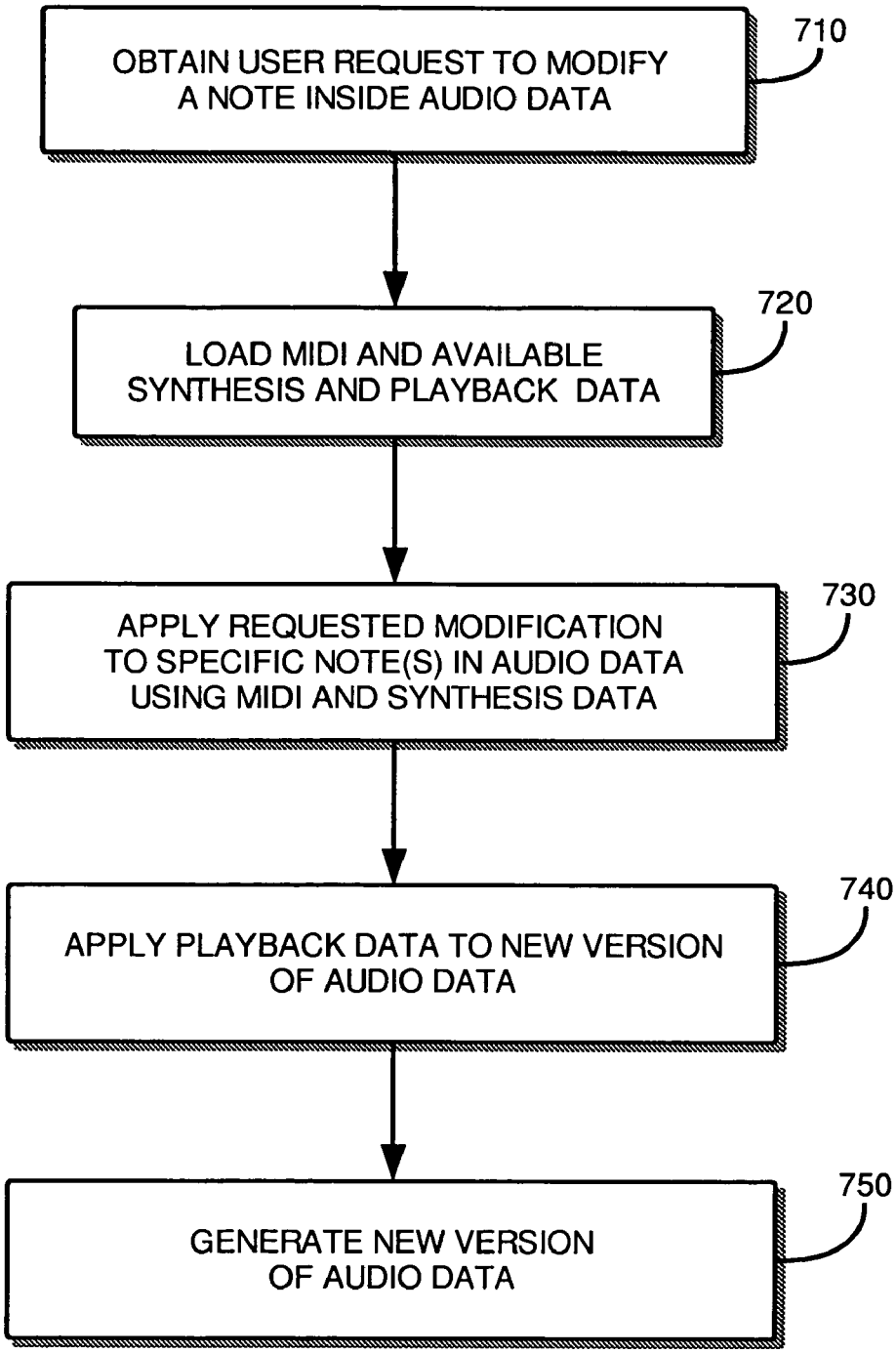
FIG. 7 is a flowchart that illustrates steps involved in the manipulation of audio data in accordance with an embodiment of the invention.

FIG. 7 is a flowchart illustrating one embodiment of a process for manipulating audio data in accordance with an embodiment of the invention. FIG. 7 exemplifies a request from a user to manipulate one or more notes in a piece of music composed and stored using the rich audio file format disclosed herein. Likewise, any situation that requires audio manipulation can be made possible using embodiments of the invention.

At step 710, a system embodying the invention receives a request from a user to modify audio data (e.g., to change a note in the composition). The system loads the audio data, for example, in accordance with the steps described above in FIG. 6. Loading of the audio data may also occur before the user is presented with an interface showing the available tools for performing audio data manipulation. For example, a software program implementing the invention may display the waveform and/or the audio codes. Along with the data display, the user may have access, on a user interface, to any number of menus containing audio data manipulation tools.

At step 720, the system may load audio data from a stored file and/or exchange data with a peripheral device, such as a synthesizer. At step 730, the system obtains the modifications to the music notes. For example, a creative artist may choose to modify the length of a note, the pitch of a note, or any aspect of the audio data. The system may then apply the specific change and generate a new version of MIDI data. At step 740, the system applies the available synthesis parameters and playback data to the modified MIDI data, and plays the new version of the audio data. The system may then store the new version of the audio data, at step 750, optionally including storage of a revised audio waveform.

Thus, a method and apparatus for representing, storing and rendering audio data have been described. Particular embodiments described herein are illustrative only and should not limit the present invention thereby. The invention is defined by the claims and their full scope of equivalents.

What is claimed is:

1. A method enabling advanced audio manipulation comprising:

obtaining a set of waveform data;

storing the set of waveform data as a component of a first file that has a particular file format;

obtaining a set of Musical Instrument Digital Interface data;

storing the set of Musical Instrument Digital Interface data as a component of a second file that has said particular file format;

obtaining a set of synthesis parameter data;

storing the set of synthesis parameter data as a component of a third file that has said particular file format;

obtaining a set of playback parameter data; and storing the set of playback parameter data as a component of a fourth file that has said particular file format;

wherein said particular file format enables playback parameter data to remain separate from waveform data during exchange of audio data.

2. The method of claim 1 wherein obtaining said set of waveform data includes at least one of:

obtaining one track of sample sound data;

obtaining a track of data in WAVE format;

obtaining a track of data in Audio Interchange File format; or synthesizing said set of waveform data.

3. The method of claim 1 wherein said obtaining said set of Musical Instrument Digital Interface data further comprises synthesizing said set of Musical Instrument Digital Interface data.

4. The method of claim 1 wherein said obtaining said set of synthesis parameter data further comprises obtaining at least one user-defined synthesis parameter setting forth a synthesis treatment of said set of Musical Instrument Digital Interface data.

5. The method of claim 4 wherein said obtaining said at least one user-defined synthesis parameter further comprises obtaining at least one synthesis modification parameter to modify said at least one user-defined synthesis parameter.

6. The method of claim 1 wherein said obtaining said set of playback parameter data further comprises obtaining at least one user-defined playback parameter setting forth effects during rendering said set of Musical Instrument Digital Interface data.

7. The method of claim 6 wherein said obtaining said at least one user-defined playback parameter further comprises obtaining at least one playback modification parameter to modify said at least one user-defined playback parameter.

8. The method of claim 1 further comprising collecting any available data of said set of waveform data, said set of Musical Instrument Digital Interface data, said set of synthesis parameter data and said set of playback parameter data.

9. The method of claim 1 further comprising producing at least one data chunk in accordance with a format of Musical Instrument Digital Interface protocols for any of said set of waveform data, said set of Musical Instrument Digital Interface data, said set of synthesis parameter data and said set of playback parameter data.

10. The method of claim 1 further comprising:

storing the set of waveform data, the set of Musical Instrument Digital Interface data, the set of synthesis parameter data, and the set of playback parameter data in a single file that has said particular format.

11. The method of claim 1 further comprising:

storing the set of waveform data, the set of Musical Instrument Digital Interface data, and the set of synthesis parameter data in a single file that has said particular format.

12. The method of claim 1 further comprising:

storing the set of waveform data, the set of Musical Instrument Digital Interface data, and the set of playback parameter data in a single file that has said particular format.

13. The method of claim 1 further comprising:

storing the set of waveform data and the set of Musical Instrument Digital Interface data in a single file that has said particular format.

14. The method of claim 1 further comprising:

storing the set of waveform data and the set of playback parameter data in a single file that has said particular format.

15. The method of claim 1 further comprising:

storing the set of Musical Instrument Digital Interface data, the set of synthesis parameter data, and the set of playback parameter data in a single file that has said particular format.

16. The method of claim 1 further comprising:

storing the set of Musical Instrument Digital Interface data and the set of synthesis parameter data in a single file that has said particular format.

17. The method of claim 1 further comprising:

storing the set of Musical Instrument Digital Interface data and the set of playback parameter data in a single file that has said particular format.

18. A computer-readable storage medium storing a computer program configured to execute on a computing device having a processor and memory, said computer program having computer program code configured to:

obtain a set of waveform data;

storing the set of waveform data as a component of a first file that has a particular file format;

obtain a set of Musical Instrument Digital Interface data;

storing the set of Musical Instrument Digital Interface data as a component of a second file that has said particular file format;

obtain a set of synthesis parameter data;

storing the set of synthesis parameter data as a component of a third file that has said particular file format;

obtain a set of playback parameter data; and storing the set of playback parameter data as a component of a fourth file that has said particular file format;

wherein said particular file format enables playback parameter data to remain separate from waveform data during exchange of audio data.

19. The computer-readable storage medium of claim 18 wherein said computer program code configured to obtain said set of waveform data further comprises computer program code configured to synthesize said set of waveform data.

20. The computer-readable storage medium of claim 18 wherein said computer program code configured to obtain said set of Musical Instrument Digital Interface data further comprises computer program code configured to synthesize said set of Musical Instrument Digital Interface data.

21. The computer-readable storage medium of claim 18 wherein said computer program code configured to obtain said set of synthesis data further comprises computer program code configured to obtain at least one user-defined synthesis parameter setting forth a synthesis treatment of said set of Musical Instrument Digital Interface data.

22. The computer-readable storage medium of claim 21 wherein said computer program code configured to obtain said at least one user-defined synthesis parameter further comprises computer program code configured to obtain at least one synthesis modification parameter to modify said at least one user-defined synthesis parameter.

23. The computer-readable storage medium of claim 18 wherein said computer program code configured to obtain said set of playback data further comprises obtaining at least one user-defined playback parameter setting forth effects during rendering said set of Musical Instrument Digital Interface data.

24. The computer-readable storage medium of claim 23 wherein said computer program code configured to obtain said at least one user-defined playback parameter further comprises computer program code configured to obtain at least one playback modification parameter to modify said at least one user-defined playback parameter.

25. The computer-readable storage medium of claim 18 wherein said computer program code further comprises computer program code configured to collect any available data of said set of waveform data, said set of Musical Instrument Digital Interface data, said set of synthesis parameter data and said set of playback parameter data.

26. The computer-readable storage medium of claim 18 wherein said computer program code further comprises computer program code configured to produce at least one data chunk in accordance with a format of Musical Instrument Digital Interface protocols for any of said set of waveform data, said set of Musical Instrument Digital Interface data, said set of synthesis parameter data and said set of playback parameter data.

27. A method for manipulating audio data comprising:

obtaining an audio manipulation request associated with an audio waveform;

determining that an audio file comprising sample data associated with said audio waveform also comprises data that sets forth a specific synthesis treatment to be used for processing sound for a given instrument, wherein said audio file specifies the given instrument for which said specific synthesis treatment is to be used; and in response to said audio manipulation request, performing the requested audio manipulation and processing sound for said given instrument on a playback device using the specific synthesis treatment that is specified by said data, thereby overriding any synthesis treatment that the playback device would otherwise use for the given instrument.

28. The method of claim 27 wherein said data that sets forth a specific synthesis treatment to be used for processing a given sound further comprises a set of playback parameters.

29. An apparatus for manipulating audio data comprising:

means for obtaining an audio manipulation request associated with an audio waveform;

means for determining that an audio file comprising sample data associated with said audio waveform also comprises data that sets forth a specific synthesis treatment to be used for processing sound for a given instrument, wherein said audio file specifies the given instrument for which said specific synthesis treatment is to be used; and means for responding to said audio manipulation request by performing the requested audio manipulation and processing sound for said given instrument on a playback device using the specific synthesis treatment that is specified by said data, thereby overriding any synthesis treatment that the playback device would otherwise use for the given instrument.

* * * * *